US005977264A

United States Patent [19]

Ichikawa et al.

[11] Patent Number: 5,977,264

[45] Date of Patent: Nov. 2, 1999

[54] GOLF BALL

[75] Inventors: Yasushi Ichikawa; Shunichi Kashiwagi; Rinya Takesue, all of Chichibu, Japan

[73] Assignee: Bridgestone Sports Co., Ltd., Tokyo, Japan

[21] Appl. No.: 08/964,088

[22] Filed: Nov. 4, 1997

[30] Foreign Application Priority Data

Nov. 5, 1996 [JP] Japan ..... 8-310184

[51] Int. Cl.[6] ..... A63B 37/12; C08L 33/02

[52] U.S. Cl. ..... 525/329.9; 473/372; 473/373; 473/385

[58] Field of Search ..... 525/329.9; 473/372, 473/373, 385

[56] References Cited

U.S. PATENT DOCUMENTS 5,439,227 8/1995 Egashira .

FOREIGN PATENT DOCUMENTS 61-281145 12/1986 Japan .
1-207343 8/1989 Japan .
A 24084/1995 1/1995 Japan .
9731956 9/1997 WIPO .

*Primary Examiner*—David Buttner
*Attorney, Agent, or Firm*—Sughrue, Mion, Zinn, MacPeak & Seas, PLLC

[57] ABSTRACT

The invention provides a golf ball comprising a solid core, an intermediate layer, and a cover. The cover is formed of a diamine complex ionomer resin having a flexural rigidity of 340–410 MPa. The intermediate layer is formed of an ionomer resin or non-ionomer thermoplastic elastomer having a flexural rigidity of 20–350 MPa. The hardness of the ball is adjusted to a distortion of 2.6–4.5 mm under a load of 100 kg.

4 Claims, No Drawings

GOLF BALL

BACKGROUND OF THE INVENTION

1. Field of the Invention

This invention relates to a golf ball comprising a solid core, an intermediate layer, and a cover, and more particularly, such a golf ball wherein the cover is formed of a specific diamine complex ionomer resin so that the ball is improved in flight performance, hitting feel and durability.

2. Prior Art

Various types of golf balls are available in the market. The majority of the ball market is shared by two-piece solid golf balls in which a rubber base core is enclosed with a cover of ionomer resin or the like and wound golf balls in which a wound core having thread rubber wound on a solid or liquid center is enclosed with a cover.

Most average golfers favor two-piece solid golf balls because of superior flight performance and durability. The two-piece solid golf balls, however, have the drawback that hitting feel is hard and controllability is low because of quick separation of the ball from the club head. Thus many professional golfers and low-handicap players prefer wound golf balls to two-piece solid golf balls. The wound golf balls are superior in feel and control, but inferior to two-piece solid golf balls in flight distance and durability.

Under the present situation that two-piece solid golf balls and wound golf balls have contradictory characteristics as mentioned above, players make a choice of golf balls depending on their own skill and preference.

In order to develop solid golf balls having a feel approximate to the wound golf balls, various two-piece solid golf balls of the soft type have been proposed. To obtain such two-piece solid golf balls of the soft type, soft cores are used. Softening the core can reduce resilience, deteriorate flight performance, and substantially lower durability, resulting in two-piece solid golf balls which not only fail to possess their characteristic excellent flight performance and durability, but also lose actual playability. Differently stated, while the structure of conventional two-piece solid golf balls is determined by the desire to optimize three factors, softness, resilience and durability, an attempt to improve one of these factors tends to sacrifice the remaining factors.

To solve the above-mentioned problem, JP-A 24084/1995 proposes a golf ball comprising a core, an intermediate layer surrounding the core, and a cover surrounding the intermediate layer. In order that the ball of this structure exert its performance to a full extent, it is desired to further improve the materials used therein. There is a need for further research work to improve the golf ball having an intermediate layer between a core and a cover.

SUMMARY OF THE INVENTION

An object of the invention is to provide a golf ball of the core/intermediate layer/cover structure having excellent flight performance, impact durability and pleasant hitting feel.

We have found that a highly resilient cover is obtained when it is formed of a resin component mainly comprising a diamine complex ionomer resin obtained by reacting a divalent metal ion crosslinked form of an ethylene-unsaturated carboxylic acid copolymer with an amine compound having at least two primary or secondary amino groups, and having a relatively high flexural rigidity. The cover is combined with an intermediate layer formed of a resin component having a relatively low flexural rigidity. The hardness of the golf ball as a whole is adjusted to an optimum value. Then there is obtained a golf ball satisfying all the three factors including flight performance, impact durability and hitting feel.

More specifically, the golf ball of the invention is of the type comprising a solid core, an intermediated layer surrounding the core, and a cover surrounding the intermediate layer. (1) When the cover is formed of a resin component based on a diamine complex ionomer resin obtained by reacting a divalent metal ion crosslinked form of an ethylene-unsaturated carboxylic acid copolymer with an amine compound having at least two primary or secondary amino groups, and having a flexural rigidity of 340 to 410 MPa, the cover exhibits high resilience which has never been accomplished by blends of conventional ionomer resins. Then the ball as a whole is significantly improved in resilience or restitution. Upon full shots with a driver, the golf ball offers an optimum rate of spin, an outstandingly added distance and a very soft pleasant feel. In addition to (1), (2) when the intermediate layer is formed of a resin component mainly comprising an ionomer resin or non-ionomer thermoplastic elastomer and having a flexural rigidity of 20 to 350 MPa, and (3) the hardness of the golf ball is adjusted to a distortion of 2.6 to 4.5 mm under a constant load of 100 kg. Then there is obtained a durable high quality golf ball of the core/intermediate layer/cover structure capable of exerting the above-mentioned performance to a full extent.

Accordingly, the present invention provides a golf ball comprising a solid core, an intermediate layer surrounding the core, and a cover surrounding the intermediate layer, wherein (1) the cover is formed of a resin component mainly comprising a diamine complex ionomer resin obtained by reacting a divalent metal ion crosslinked form of an ethylene-unsaturated carboxylic acid copolymer with an amine compound having at least two primary or secondary amino groups, the resin component having a flexural rigidity of 340 to 410 MPa, (2) the intermediate layer is formed of a resin component mainly comprising an ionomer resin or non-ionomer thermoplastic elastomer and having a flexural rigidity of 20 to 350 MPa, and (3) the golf ball has a hardness corresponding to a distortion of 2.6 to 4.5 mm under a constant load of 100 kg.

DETAILED DESCRIPTION OF THE INVENTION

The golf ball of the invention is comprised of a solid core, an intermediate layer surrounding the outer surface of the core, and a cover surrounding the outer surface of the intermediate layer. The material and flexural rigidity of the cover, the material and flexural rigidity of the intermediate layer, and the hardness of the ball are selected in specific ranges.

The cover is formed of a resin component mainly comprising a diamine complex ionomer resin obtained by reacting a divalent metal ion crosslinked form of an ethylene-unsaturated carboxylic acid copolymer with an amine compound having at least two primary or secondary amino groups. The resin component should have a flexural rigidity 340 to 410 MPa.

In the divalent metal ion crosslinked form of ethylene-unsaturated carboxylic acid copolymer, the unsaturated carboxylic acid may be selected from unsaturated carboxylic acids having 3 to 6 carbon atoms, for example, acrylic acid, methacrylic acid, maleic acid, and fumaric acid, with the methacrylic acid and acrylic acid being most preferred.

In the copolymer, the content of unsaturated carboxylic acid is preferably 10 to 20% by weight, more preferably 10 to 15% by weight. Copolymers containing less than 10% by weight of the unsaturated carboxylic acid would be less rigid and less resilient. A copolymer containing more than 20% by weight of the unsaturated carboxylic acid would be too rigid so that the resin might become brittle, resulting in a ball losing impact durability. Additionally, a diamine complex ionomer resin obtained by reacting it with an amine compound would have a low melting point which becomes a problem on practical use.

Preferably 20 to 80 mol %, more preferably 25 to 70 mol % of the carboxyl group of the unsaturated carboxylic acid in the copolymer is neutralized with a divalent metal ion. A degree of neutralization of less than 20 mol % would lead to shortage of rigidity and resiliency. A degree of neutralization of more than 80 mol % would detract from flow and workability rather than improving physical properties. Examples of the divalent metal ion used for neutralization include $Zn^{++}$, $Co^{++}$, $Ni^{++}$, $Cu^{++}$, $Pb^{++}$ and $Mg^{++}$, with the $Zn^{++}$and $Mg^{++}$ being preferred.

Examples of the amine compound having at least two primary or secondary amino groups which is reacted with the divalent metal ion crosslinked form of ethylene-unsaturated carboxylic acid copolymer include alicyclic diamines having a norbornane skeleton such as norbornanedimethylamine, and m-xylylenediamine, o-xylylenediamine, p-xylylenediamine, and hydrogenated products thereof such as 1,3-bisaminomethyl-cyclohexane, 1,2-bisamiomethylcyclohexane, and 1,4-bisaminomethylcyclohexane. Of these amines, 1,3-bisaminomethylcyclohexane, 1,2-bisamiomethylcyclohexane, and 1,4-bisaminomethylcyclohexane which are hydrogenated products of m-xylylenediamine, o-xylylenediamine, and p-xylylenediamine, respectively, are preferred because the diamine complex ionomer resins obtained therefrom are heat resistant and easy to mold. The alicyclic diamines having a norbornane skeleton such as norbornanedimethylamine are more preferred because the resins obtained therefrom are more heat resistant and easy to mold.

The amine compounds are generally used in an amount of 8 to 100 mol % based on the moles of the carboxyl group of the divalent metal ion crosslinked form of ethylene-unsaturated carboxylic acid copolymer. Less than 8 mol % of the amine compound would fail to achieve the desired rigidity and resilience. If the amine compound is added in an excessive amount, the excess of the amine compound would bleed out.

In preparing the diamine complex ionomer resin according to the invention, the reaction procedure is not critical. The diamine complex ionomer resin may be prepared, for example, by reacting an ethylene-unsaturated carboxylic acid copolymer with a metal compound to form an ionomer resin and then melt mixing an amine compound with the ionomer resin; by melt mixing an ethylene-unsaturated carboxylic acid copolymer with an amine complex salt of a metal compound and an amine compound; or by melt mixing the three components at the same time. The melt mixing step is generally carried out at a temperature above the melting point of the ionomer resin to be formed, typically in the range of 150 to 250° C. by means of an extruder or the like.

The diamine complex ionomer resin obtained by reacting a divalent metal ion crosslinked form of ethylene-unsaturated carboxylic acid copolymer with an amine compound having at least two primary or secondary amino groups is commercially available, for example, in the trade name of High Performance Resin (HPR) MD451 and MD452 by Mitsui dupont Polychemical K.K. and sample resin M6008-1 by the same company.

According to the invention, the cover is mainly composed of the above-mentioned diamine complex ionomer resin while suitable agents such as other metal species ionomer resins, metal salt unneutralized resins thereof, other metal salts, other amine compounds and thermoplastic elastomers may be melt mixed in appropriate amounts in order to adjust the melt properties and rigidity of the resin.

If desired, additives may be added to the resin component, for example, pigments such as titanium dioxide, zinc oxide, and barium sulfate, UV absorbers, antioxidants, and dispersants such as metal soaps.

Understandably, the gage, specific gravity and other parameters of the cover may be properly adjusted insofar as the objects of the invention are achievable. Often the cover has a gage of 1.0 to 2.5 mm, especially 1.3 to 2.1 mm and a specific gravity of 0.90 to 1.30, especially 0.95 to 1.20.

The cover of the diamine complex ionomer resin should preferably have a surface hardness of 60 to 65 in Shore D.

The intermediate layer is formed of a resin component based on at least one member of ionomer resins and non-ionomer thermoplastic elastomers and having a flexural rigidity of 20 to 350 MPa. Such resin components are commercially available, for example, ethylene-unsaturated carboxylic acid-unsaturated carboxylate copolymers under the trade name of Surlyn 8120 (E. I. dupont) and Himilan 1855 (Mitsui dupont Polychemical K.K.); metal salts of ethylene-unsaturated carboxylic acid copolymers and blends thereof under the trade name of Himilan 1706 and 1605 (Mitsui dupont Polychemical K.K.); polyester elastomers under the trade name of Hytrel 4047 and 4767 (Toray dupont K.K.); poly-urethane elastomers under the trade name of Pandex T7890 (Dai-Nihon Ink Chemical Industry K.K.); and polyamide elastomers under the trade name of Pebax 4033SA00 (Atochem K.K.). To the resin component of the intermediate layer, various additives are added if necessary, for example, resin modifiers such as Dynalon 6100P (Nippon Synthetic Rubber K.K.), dyes, pigments such as titanium dioxide, zinc oxide and barium sulfate, UV absorbers, antioxidants, and dispersants such as metal soaps.

Understandably, the gage, specific gravity and other parameters of the intermediate layer may be properly adjusted insofar as the objects of the invention are achievable. Often the intermediate layer has a gage of 1.0 to 2.5 mm, especially 1.3 to 2.1 mm and a specific gravity of 0.90 to 1.30, especially 0.95 to 1.20.

The solid core may be formed from well-known rubber compositions by conventional methods. Most often, the core is formed of a rubber composition comprising a base rubber, a co-crosslinking agent, and a peroxide by heat compression molding. The base rubber used herein may be polybutadiene rubber or a mixture of polybutadiene rubber and polyisoprene rubber conventionally used in solid golf balls although 1,4-polybutadiene rubber having at least 90% of cis-structure is especially preferred for high resilience. The co-crosslinking agent is typically selected from zinc and magnesium salts of unsaturated fatty acids such as acrylic acid and methacrylic acid and esters such as trimethylpropane trimethacrylate which are commonly used in prior art solid golf balls. Zinc acrylate is especially preferred because of its contribution to high resilience. The amount of the co-crosslinking agent blended is preferably 15 to 30 parts by weight per 100 parts by weight of the base rubber. The peroxide may be selected from various well-known ones although dicumyl peroxide and a mixture of dicumyl peroxide and 1,1-bis(t-butylperoxy)-3,3,5-trimethylcyclohexane are preferred. The amount of the peroxide blended is preferably 0.5 to 1 part by weight per 100 parts by weight of the base rubber.

If desired, an antioxidant and a filler for adjusting specific gravity such as zinc oxide and barium sulfate are blended in the rubber composition. Although the amount of the specific gravity adjusting filler blended is not critical, it is preferably blended in an amount of 0 to 30 parts by weight per 100 parts by weight of the base rubber so that the ball may have a weight of up to 45.93 grams.

The hardness of the core is preferably controlled to a distortion of 2.8 to 5.0 mm, especially 3.0 to 4.5 mm under a constant load of 100 kg in order to provide a soft hitting feel. A hard core with a distortion of less than 2.8 mm would provide a ball with poor hitting feel whereas a soft core with a distortion of more than 5.0 mm would result in a ball which is short in restitution and hence, flight distance. Preferably, the core has a diameter of 34.3 to 38.7 mm, especially 34.7 to 37.9 mm and a weight of 28.5 to 35.0 grams, especially 29.5 to 33.0 grams.

The golf ball of the present invention may be prepared by any desired method, for example, by forming a core by a conventional procedure, injection molding an intermediate layer material around the core, and injection molding a cover stock thereon. Alternatively, a core is enclosed with two pairs of preformed half shells for the intermediate layer and the cover, followed by heat compression molding.

The thus obtained golf ball of the invention may be formed with dimples in the cover surface in a conventional manner. The ball as molded may be subject to finishing steps including buffing, painting and stamping.

The golf ball as a whole should have a hardness corresponding to a distortion of 2.6 to 4.5 mm, especially 2.7 to 4.0 mm under a constant load of 100 kg. A ball with a distortion of less than 2.6 mm gives a hard hitting feel whereas a ball with a distortion of more than 4.5 mm is less resilient and short in flight distance.

While the golf ball of the invention is constructed as mentioned above, it should have a diameter and weight complying with the Rules of Golf.

EXAMPLE

Examples of the invention are given below by way of illustration and not by way of limitation.

Examples 1–6 and Comparative Examples 1–4

Solid cores were molded from the rubber compositions shown in Table 1. Three-piece golf balls (Examples 1–6 and Comparative Examples 3–4) and two-piece golf balls (Comparative Examples 1–2) were prepared by combining the core with the intermediate layer and the cover as shown in Table 2. Note that for the core, intermediate layer and cover, all the amounts of ingredients blended are parts by weight.

More specifically, the core was prepared by milling the ingredients in a roll mill and molding the mixture under pressure at 155° C. for 15 minutes. The intermediate layer was formed around the core by injection molding. The cover was formed around the intermediate layer (or around the core in the case of two-piece balls) by injection molding.

The thus obtained golf balls were examined for physical properties (hardness and restitution), flight performance, feel, and impact durability by the following tests.

Resin flexural rigidity

A resin was heat pressed into a sheet of about 2 mm thick, which was allowed to stand at 23° C. over 2 weeks for crystallization and stabilization. The sheet was then measured for flexural rigidity according to ASTM D-747.

Resin hardness (Shore D)

A resin was heat pressed into a sheet of about 2 mm thick, which was allowed to stand at 23° C. over 2 weeks for crystallization and stabilization. The sheet was then measured for Shore D hardness according to ASTM D-2240.

Ball hardness

A distortion (mm) of a ball under a constant load of 100 kg was measured.

Ball restitution (initial velocity)

An initial velocity (m/s) was measured according to the procedure of USGA (or R&A).

Flight performance

Using a hitting machine by True Temper Co., the ball was actually hit with a driver (#W1) at a head speed of 45 m/s (HS45) to measure a carry and total distance. The club used herein was "PRO 230TITAN" by Bridgestone Sports Co., Ltd. with specifications: loft 11°, shaft Harmotechlite HM50J (HK), hardness S. and balance D2.

Hitting Feel

Five golfers with a head speed of 45 m/sec., (HS45) actually hit the balls. The ball was rated "O" for a soft pleasant feel not shivering the hands and "X" for a hard, hand-shivering, unpleasant feel.

Durability against hitting

Using a hitting machine by True Temper Co., the ball was successively hit 200 times with a driver (#W1) at a head speed of 45 m/s (HS45) before it was observed for surface cracks. In each Example, 20 samples were tested. The number of cracked ball samples is reported as an index based on a value of 100 for Comparative Example 1.

TABLE 1

| Composition (pbw) | Core type A | B | C |
|---|---|---|---|
| Cis-1,4-polybutadiene*1 | 100 | 100 | 100 |
| Zinc diacrylate | 27 | 27 | 28 |
| Zinc oxide | 28 | 19.5 | 21.5 |
| Antioxidant | 0.1 | 0.1 | 0.1 |
| Dicumyl oxide | 1 | 1 | 1 |
| Zn salt of pentachlorothiophenol | 1 | 1 | 1 |

*1BR01 by Nippon Synthetic Rubber K.K.

TABLE 2

| | | Example 1 | 2 | 3 | 4 | 5 | 6 | Comparative Example 1 | 2 | 3 | 4 |
|---|---|---|---|---|---|---|---|---|---|---|---|
| Core | Type | A | B | B | A | A | A | C | C | A | A |
| | Hardness (mm) | 3.8 | 3.8 | 3.8 | 3.8 | 3.8 | 3.6 | 3.8 | 3.8 | 3.8 | 3.8 |
| Inter- | AD6511*2 | 35 | — | — | 50 | 35 | 35 | — | — | — | — |
| mediate | ADB512*3 | 35 | — | — | — | 35 | 35 | | | — | — |
| layer | D6100P*4 | 30 | — | — | — | 30 | 30 | | | — | — |
| | H4047*5 | — | 100 | — | — | — | — | | | 100 | 100 |
| | H4767*6 | — | — | 100 | — | — | — | | | — | — |

TABLE 2-continued

| | | | Example | | | | | | Comparative Example | | | |
|---|---|---|---|---|---|---|---|---|---|---|---|---|
| | | | 1 | 2 | 3 | 4 | 5 | 6 | 1 | 2 | 3 | 4 |
| | S8120*7 | | — | — | — | 50 | — | — | | | — | — |
| | Resin flexural rigidity (Mpa) | | 200 | 55 | 100 | 160 | 200 | 200 | | | 55 | 55 |
| | Gage (mm) | | 1.6 | 1.6 | 1.6 | 1.6 | 1.6 | 1.6 | | | 1.6 | 1.6 |
| Cover | HPR MD451*8 | | — | — | — | — | 100 | — | — | — | — | — |
| | M6008-1*9 | | 100 | 100 | 100 | 100 | — | 50 | 100 | — | — | — |
| | H1706*10 | | — | — | — | — | — | — | — | 50 | 50 | — |
| | H1605*11 | | — | — | — | — | — | 50 | — | 50 | 50 | — |
| | AM7317*12 | | — | — | — | — | — | — | — | — | — | 50 |
| | AM7318*13 | | — | — | — | — | — | — | — | — | — | 50 |
| | Resin flexural rigidity (Mpa) | | 380 | 380 | 380 | 380 | 400 | 390 | 380 | 350 | 350 | 430 |
| | Hardness (Shore D) | | 61 | 61 | 61 | 61 | 65 | 65 | 61 | 63 | 63 | 67 |
| | Gage (mm) | | 1.5 | 1.5 | 1.5 | 1.5 | 1.5 | 1.5 | 3.0 | 3.0 | 1.5 | 1.5 |
| Ball | Hardness (mm) | | 2.8 | 3.2 | 3.0 | 2.7 | 2.1 | 2.6 | 2.6 | 2.5 | 3.1 | 2.4 |
| | Initial velocity (m/s) | | 77.4 | 77.0 | 77.0 | 77.2 | 77.4 | 77.4 | 76.9 | 76.6 | 76.8 | 77.3 |
| Test | #W1/HS45 | Carry (m) | 218.5 | 217.5 | 218.0 | 217.5 | 216.5 | 216.5 | 217.0 | 216.0 | 216.0 | 217.5 |
| | | Total (m) | 227.5 | 227.0 | 227.0 | 226.5 | 227.0 | 227.5 | 225.0 | 225.5 | 225.0 | 227.0 |
| | Hitting feel | | ○ | ○ | ○ | ○ | ○ | ○ | ○ | ○ | ○ | x |
| | Durability index after 200 impacts | | 125 | 115 | 120 | 125 | 110 | 125 | 100 | 100 | 100 | 90 |

*2Ionomer resin Zn salt, Shore D 61, E. I. duPont de Nemours & Co.
*3Ionomer resin Na salt, Shore D 63, E. I. duPont de Nemours & Co.
*4Hydrogenated polybutadiene, Nippon Synthetic Rubber K.K.
*5Polyester elastomer, Shore D 40, Toray duPont K.K.
*6Polyester elastomer, Shore D 46, Toray duPont K.K.
*7Ionomer resin Na salt, Shore D 45, E. I. duPont de Nemours & Co.
*8diamine complex ionomer resin Zn salt 1,3-bisaminocyclo-hexane reaction product, Shore D 65, acid content 15 wt %, Mitsui duPont Polychemical K.K.
*9diamine complex ionomer resin Zn salt norbornanedimethyl-amine reaction product, Shore D. 61, acid content 15 wt %, Mitsui duPont Polychemical K.K.
*10Ionomer resin Zn salt, Shore D 62, acid content 15 wt %, Mitsui duPont Polychemical K.K.
*11Ionomer resin Na salt, Shore D 63, acid content 15 wt %, Mitsui duPont Polychemical K.K.
*12Ionomer resin Zn salt, Shore D 65, acid content 18 wt %, Mitsui duPont Polychemical K.K.
*13Ionomer resin Na salt, Shore D 66, acid content 18 wt %, Mitsui duPont Polychemical K.K.

As is evident from Table 2, the two-piece golf balls of Comparative Examples 1 and 2 show a good soft hitting feel, but are inferior in restitution, flight distance and durability to the three-piece golf balls of Examples. The ball of Comparative Example 3 which is a three-piece golf ball using a blend of conventional ionomer resins as the cover shows a good hitting feel, but is inferior in restitution, flight distance and durability to the three-piece golf balls of Examples. The ball of Comparative Example 4 which is a three-piece golf ball using a blend of high hardness ionomer resins having an acid content of more than 16 wt % as the cover has a higher hardness because of the high hardness and flexural rigidity of the cover resins and thus provides a poor hitting feel. In addition, because of the substantial hardness difference between the core and the intermediate layer, the ball of Comparative Example 4 is inferior in durability to the three-piece golf balls of Examples.

The golf balls of the invention ensure excellent flight performance, pleasant hitting feel and durability against hitting.

Japanese Patent Application No. 310184/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball comprising a solid core, an intermediate layer surrounding the core, and a cover surrounding the intermediate layer, wherein (1) said cover is formed of a resin component mainly comprising a diamine complex ionomer resin obtained by reacting a divalent metal ion crosslinked form of an ethylene-unsaturated carboxylic acid copolymer with an amine compound having at least two primary or secondary amino groups, the resin component having a flexural rigidity of 340 to 410 MPa, (2) said intermediate layer is formed of a resin component mainly comprising an ionomer resin or non-ionomer thermoplastic elastomer and having a flexural rigidity of 20 to 350 MPa, and (3) the golf ball has a hardness corresponding to a distortion of 2.6 to 4.5 mm under a constant load of 100 kg.

2. The golf ball of claim 1 wherein the amine compound of he diamine complex ionomer resin is norbornanedimethyl-amine.

3. The golf ball of claim 1 wherein the divalent metal ion of the diamine complex ionomer resin is zinc.

4. The golf ball of claim 1 wherein the diamine complex ionomer resin has a surface hardness of 60 to 65 in Shore D.

* * * * *